United States Patent [19]

Tanaka et al.

[11] Patent Number: 4,876,861

[45] Date of Patent: Oct. 31, 1989

[54] DEFROST-WATER VAPORIZER OF A REFRIGERATOR

[75] Inventors: Hiroshi Tanaka, Hirakata; Yasukiyo Murata; Kazumi Eto, both of Ibaraki, all of Japan

[73] Assignee: Kabushiki Kaisha Toshiba, Kawasaki, Japan

[21] Appl. No.: 298,963

[22] Filed: Jan. 19, 1989

[30] Foreign Application Priority Data

Jan. 20, 1988 [JP] Japan ..... 63-10213
Mar. 14, 1988 [JP] Japan ..... 63-34168[U]

[51] Int. Cl.[4] ..... F25B 47/00
[52] U.S. Cl. ..... 62/279; 62/281
[58] Field of Search ..... 62/277, 279, 281, 282, 62/295

[56] References Cited

U.S. PATENT DOCUMENTS 2,167,442 7/1939 Alsing ..... 62/279
2,963,885 12/1960 Loewenthal ..... 62/279 X
4,156,352 5/1979 Gelbard et al. ..... 62/295 X
4,497,183 2/1985 Gelbard et al. ..... 62/279 X

FOREIGN PATENT DOCUMENTS 18-25908 10/1943 Japan .
47-12772 5/1972 Japan .
58-135676 9/1983 Japan .

*Primary Examiner*—Lloyd L. King
*Attorney, Agent, or Firm*—Oblon, Spivak, McClelland, Maier & Neustadt

[57] ABSTRACT

A defrost-water vaporizer of a refrigerator includes a water reservoir mounted in a machine compartment with a compressor so as to receive defrost water resulting from the melting of frost adherent to an evaporator to be discharged outside a storage space of the refrigerator, a plurality of vaporizing elements absorbing the defrost water in the water reservior by capillarity and vaporizing the defrost water from the surfaces, a lower support formed from an elastic material and supporting the vaporizing elements in the water reservior, and an upper support formed from an elastic material and supporting the upper ends of the vaporizing elements. Lower ends of the vaporizing elements are inserted in the water reservoir so as to come into contact with the defrost water in the water reservoir. Upper ends of the vaporizing elements are positioned higher than the compressor.

6 Claims, 4 Drawing Sheets

Fig. 1
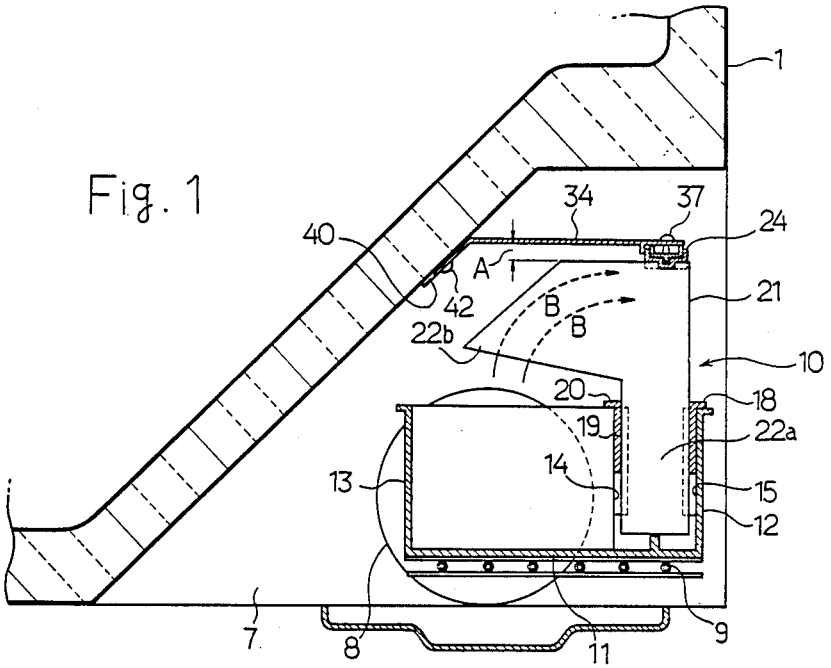
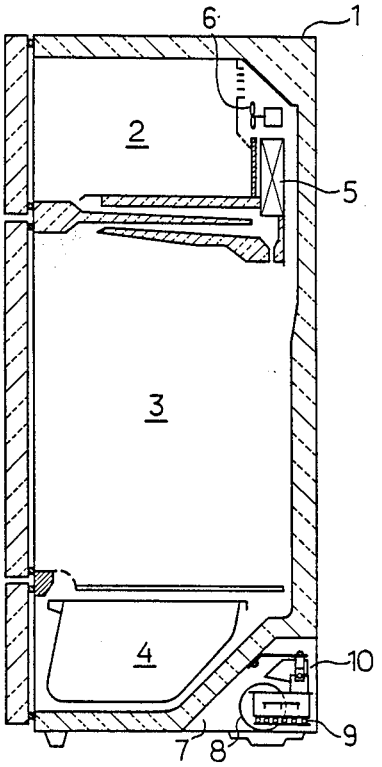
Fig. 2

DEFROST-WATER VAPORIZER OF A REFRIGERATOR

BACKGROUND OF THE INVENTION

1. Field of the Invention

This invention relates to a defrost-water vaporizer of a refrigerator for vaporizing defrost water from an evaporator provided in the storage space of the refrigerator.

2. Description of the Prior Art

Refrigerators generally have a machine compartment provided in the outer bottom portion of a heat-insulated cabinet in which the storage space is defined. The machine compartment is provided, at the rear portion of the interior, with a compressor supplying refrigerant to an evaporator provided in the storage space and a vaporizing pan support. A conduit is extended at the underside of the vaporizing pan support so that high temperature refrigerant is circulated from the compressor therethrough. A vaporizing pan is mounted on the vaporizing pan support at the front portion of the interior of the machine compartment. Defrost water is introduced from the evaporator to the vaporizing pan and vaporized by utilizing heat from the high temperature refrigerant.

However, in the above-described construction, the defrost water is vaporized only from the surface thereof, which entails the problem of low vaporizing efficiency. Conventionally, the surface area of the defrost water received by the vaporizing pan has been increased to compensate for the low vaporizing efficiency and therefore, a wide, large vaporizing pan has been required. Moreover, space is required so that air flows around the vaporizing pan. Consequently, the machine compartment has been required to have a large interior space, which has decreased the inner volume of the cabinet and lowered the volume efficiency of the cabinet.

SUMMARY OF THE INVENTION

Therefore, a primary object of the present invention is to provide a defrost-water vaporizer of a refrigerator wherein the defrost water can be vaporized with high efficiency.

A second object of the present invention is to provide a defrost-water vaporizer of a refrigerator wherein the construction of vaporizing the defrost water can be rendered compact.

A third object of the present invention is to provide a defrost-water vaporizer of a refrigerator wherein defrost-water vaporizing elements may be prevented from inducing vibration noise.

In a refrigerator comprising a heat-insulated cabinet in which an evaporator is provided, a machine compartment formed at the outside of the cabinet and opened to the atmosphere, and a compressor provided in the machine compartment for supplying refrigerant to the evaporator, the defrost-water vaporizer of the present invention is provided in the machine compartment. The defrost-water vaporizer comprises a water reservoir for receiving water resulting from the melting of frost adherent to the evaporator, a plurality of vaporizing elements, the lower ends of which are inserted in the water reservoir so as to come into contact with the defrost water in the water reservoir. The upper ends of the vaporizing elements are positioned higher than the compressor. One surfaces of the vaporizing elements are exposed to the atmosphere so that the defrost water absorbed from the water reservoir by capillarity is vaporized on the surfaces exposed to the atmosphere. The defrost-water vaporizer further comprises a lower support formed from an elastic material and provided between the lower portions of the vaporizing elements and the inner side wall of the water reservoir for supporting the vaporizing elements in the water reservoir.

The defrost water is received by the water reservoir and vaporized from the surfaces of the vaporizing elements. The area of the vaporizing elements utilized for vaporization is increased as compared with that of the conventional construction in which the defrost water is vaporized from the surface thereof, thereby improving the defrost-water vaporizing efficiency. Furthermore, the size of the water reservoir may be reduced and the space around the water reservoir may also be reduced, whereby the construction of vaporizing the defrost water may be rendered compact and accordingly, the machine compartment may be rendered small. Consequently, the inner volume of the cabinet may be increased. Furthermore, since direct contact of the vaporizing elements to the water reservoir may be prevented by the elastic lower support, thereby preventing the occurrence of vibration noise.

According to another aspect of the present invention, each above-described vaporizing element includes a raised portion raised from the water reservoir and an extended portion laterally extended from the upper end thereof, the extended portion being placed over the compressor. Since an upward air current induced by heat from the compressor flows along the extended portions of the vaporizing elements, the defrost-water vaporizing efficiency may be improved.

According to further another aspect of the invention, a plurality of vaporizing plates are employed for the vaporizing elements. Furthermore, an upper support is provided for securing the upper portions of the vaporizing plates in the water reservoir. The upper support comprises a supporting member and an elastic spacer provided between the supporting member and the vaporizing plates. The shock of external force may be absorbed by the upper support having elastic spacers, thereby preventing the vaporizing plates from being broken by the external force.

According to a further another aspect of the invention, the defrost-water vaporizer is provided with a covering plate. The covering plate covers the vaporizing elements so that a predetermined space is provided between the upper ends of the vaporizing elements and the covering plate. One of ends of the covering plate is secured to the heat-insulated cabinet side. Since the upward air current induced in the machine compartment by the heat from the compressor is introduced by the covering plate to effectively flow along the vaporizing elements, the defrost-water vaporizing efficiency may be improved.

According to further another aspect of the invention, the other end of the above-described covering plate is secured to the upper support. Since the covering plate causes the vaporizing elements to be placed away from the heat-insulated cabinet a by predetermined distance, the vaporizing elements may be prevented from colliding with the cabinet owing to vibration or the like. Consequently, the occurrence of noise owing to the collision, damage of the vaporizing elements and the tearing of paint film on the cabinet may be prevented.

Other objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

In the accompanying drawings:

FIG. 1 is longitudinal cross sectional view of the major part of the defrost-water vaporizer of an embodiment in accordance with the invention;

FIG. 2 is a longitudinal cross sectional view of a refrigerator;

DESCRIPTION OF THE PREFERRED EMBODIMENT

Figure 3:
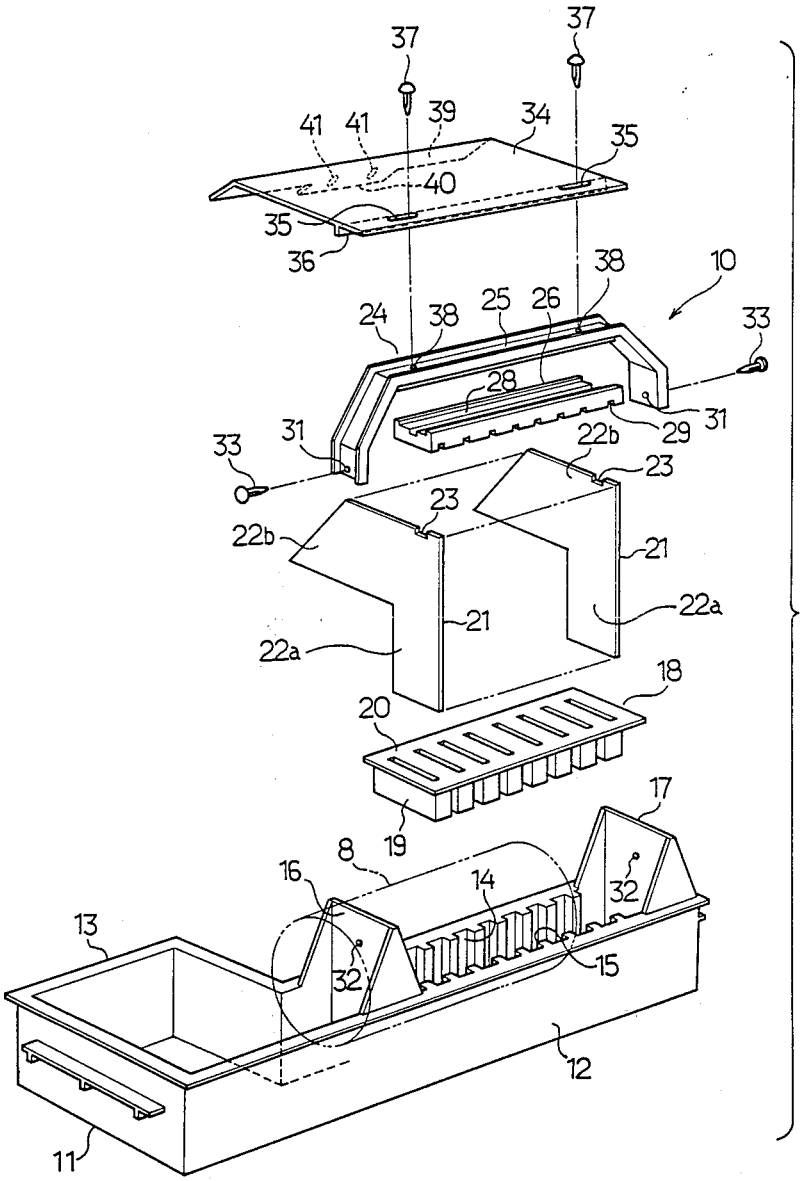
FIG. 3 is an exploded perspective view of the defrost-water vaporizer.

Two embodiments of the defrost-water vaporizer in accordance with this invention will now be described with reference to the drawings. Referring first to FIG. 2 of the drawings, a heat-insulated cabinet 1 of a refrigerator has a storage space which is divided into a freezing compartment 2, a storage compartment 3 and a vegetable compartment 4 therein. The temperature at the freezing compartment 2 is determined to be lower than the temperature at the storage compartment 3, and the temperature at the vegetable compartment 4 is determined to be higher than that at the storage compartment 3. An evaporator 5 is mounted at the rear side of the freezing compartment 2. A chilled air is supplied by a fan 6 from around the evaporator 5 to the freezing compartment 2 and storage compartment 3. A machine compartment 7 is formed at the outer rear bottom of the cabinet 1. The machine compartment 7 is open to the atmosphere. A compressor such as a rotary compressor 8, a condenser tube 9 and a defrost-water vaporizer 10 in accordance with this invention are provided in the machine compartment 7. Refrigerant is supplied from the rotary compressor 8 to the evaporator 5.

The defrost-water vaporizer 10 will now be described in detail with reference to FIGS. 1 and 3. A water reservoir 11 having an upper open end receives defrost water resulting from the melting of frost adherent to the evaporator 5 to be discharged to the outside of the cabinet 3. The water reservoir 11 includes a narrow portion 12 and a wide portion 13. The water reservoir 11 is placed on the condenser tube 9 such that the narrow portion 12 is positioned at the rear of the rotary compressor 8 with the wide portion 13 positioned at the side of the rotary compressor 8. Vertical grooves 14 and 15 are formed in the inside surfaces of oppositely disposed side walls of the narrow portion 12 of the water reservoir 11, respectively. Two holding plates 16 and 17 are upwardly projected from both ends of the narrow portion 12, respectively. A lower support 18 is formed from an elastic material such as ethylene propylene rubber. The lower support 18 has a generally rectangular portions 19 the number and spacing of which correspond to those of the grooves 14 and 15, and a flanged portion 20 integrally coupling the rectangular portions 19. The rectangular portions 19 are inserted in the grooves 14 and 15 respectively till the flanged portion 20 comes into contact with the upper edges of the side walls of the narrow portion 12, thereby mounting the lower support on the water reservoir 11. A plurality of vaporizing plates 21 as vaporizing elements are formed from a porous material such as alumina ceramics, which material having water absorbing property by capillarity. Each vaporizing plate 21 includes a raised portion 22*a* raised from the water reservoir 11 and an extended portion 22*b* laterally extended from the upper edge. The raised portions 22*a* of the vaporizing plates 21 are inserted through the rectangular portions 19 in the narrow portion 12 so that the vaporizing plates 21 are disposed in the narrow portion 12 with approximately equal spacings. In this state of condition, the raised portions 22*a* are supported by the lower support 18, and the extended portions 22*b* of the vaporizing plates 21 are forwardly extended from a side edge of the narrow portion 12 to be positioned over the rotary compressor 8. A notch 23 is formed in the upper rear edge of each vaporizing plate 21.

Figure 4:
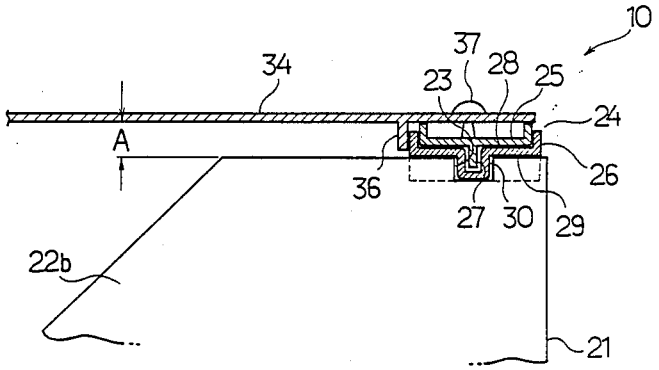
FIG. 4 is an enlarged longitudinal sectional view of the portion surrounding the covering plate of the defrost-water vaporizer.
Figure 5:
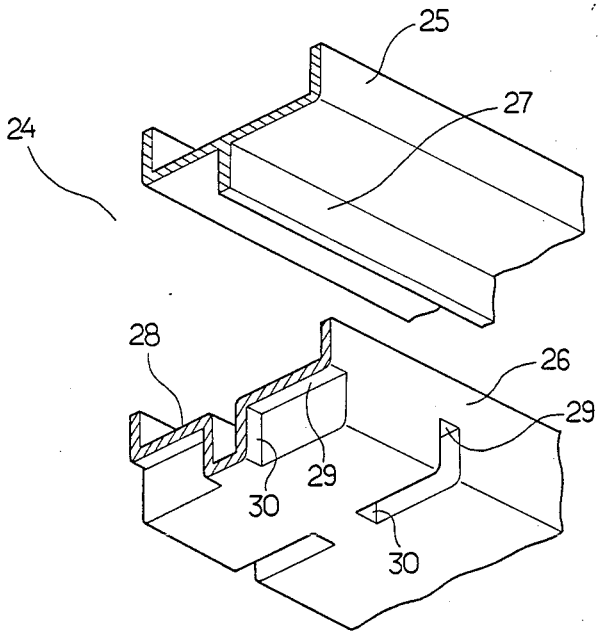
FIG. 5 s a broken exploded perspective view of the upper support.

An upper support 24 includes a supporting member 25 formed from a material such as polypropylene and having a central flat portion and downwardly inclined end portions and a spacer 26 formed from an elastic material such as ethylene propylene rubber and having approximately the same length as the flat portion of the supporting member 25. As shown in FIG. 5, the supporting member 25 has a projection 27 formed on the central underside of the flat portion and extended lengthwise. The spacer 26 has a groove 28 formed in the upper side thereof over the entire length and having approximately the same width as the flat portion of the supporting member 25. The spacer 26 also has grooves 29 formed in the underside thereof and each having approximately the same width as the thickness of the vaporizing plate 21. The number of the grooves 29 and spacing between one groove 29 and the adjacent one correspond to those of the vaporizing plates 21, respectively. The spacer 26 also has a downwardly convex portion 30 formed in the central underside thereof and extended lengthwise. The convex portion 30 of the spacer 26 is fitted with the notches 23 of the vaporizing plates 21 and the grooves 29 of the spacer 26 are fitted with the upper edge portions of the vaporizing plate 21, as shown in FIG. 4. Then, the projection 27 of the supporting member 25 is fitted with the convex portion 30 of the spacer 26 and simultaneously, the central flat portion of the supporting member 25 is inserted in the groove 28, whereby the vaporizing plates 21 are pushed downward by the supporting member 25 with the spacer 26 placed therebetween. In this state of condition, two rivets 33 are inserted through apertures 31 formed in the inclined portions of the supporter 25 to be received by apertures 32 formed in the holding plates 16 and 17, respectively, whereby all the vaporizing plates 21 are supported at the upper portions thereof by the upper support 24 having elasticity. See FIG. 3.

A rectangular covering plate 34 has the width larger than an overall dimension of the vaporizing plates 21 disposed as described above and a lateral dimension of the extended portion 22*b* of each vaporizing plate 21. The covering plate 34 has in the rear end portion, for example, two apertures 35 formed in the right-hand and left-hand rear end portions thereof and elongated in the direction that the vaporizing plates are disposed and a rib 36 formed on the underside thereof to be extended in the direction that the vaporizing plates 21 are disposed. As shown in FIG. 4, the covering plate 34 is positioned by resting the rear portion thereof on the supporting member 25 with the rib 36 abutting against the front surface of the spacer 26. In this state of condition, rivets 37 inserted through the respective apertures 35 are further inserted in apertures 38 formed in the supporting member 25, whereby the rear end portion of the covering plate 34 is secured to the upper support 24. Consequently, the vaporizing plates 21 are supported at the overall upper portions by the covering plate 34 as well as by the upper support 24. Reference character A in FIGS. 1 and 4 designates a dimension of the spacing between the upper end of the vaporizing plates 21 and covering plate 34. The dimension A is determined to take the value ranging from 5 to 10 mm, for example. The covering plate 34 covers the vaporizing plates 21 in the machine compartment 7.

The covering plate 34 has a front inclined portion 39 as shown in FIG. 3. A mounting strip 40 is extended from the central front edge of the inclined portion 39. The mounting strip 40 has, for example, two apertures 41 through which rivets 42 are inserted to be received by apertures (not shown) formed in the front wall of the machine compartment 7, as shown in FIG. 1, whereby the covering plate 34 is secured at the front end to the heat-insulated cabinet 1.

Operation of the defrost-water vaporizer of the present invention will now be described. When the evaporator 5 is defrosted, the defrost water is discharged through a conduit (not shown) to the water reservoir 11 of the defrost-water vaporizer 10. The defrost water received by the water reservoir comes into contact with the lower portions of the raised portions **22*a* of the vaporizing plates 21 and absorbed into the vaporizing plates 21 by capillarity. The defrost water thus absorbed into the vaporizing plates 21 is vaporized at the surfaces of the extended portions 22*b*. When the defrosting operation is completed, the operation of the rotary compressor 8 deactivated during the defrosting operation is restarted. Upon restart of the operation of the rotary compressor 8, heat is generated by the rotary compressor 8. The heat causes an upward air current in the machine compartment 7. The upward air current is introduced along the upper surfaces of the extended portions 22*b* of the vaporizing plates 21, thereby enhancing the vaporization of the defrost water by the vaporizing plates 21. Although the machine compartment is designed so as to have a sufficient height for piping and installation of other parts, the upward air current is prevented from flowing upward and then laterally in the machine compartment 7 owing to the covering plate 34 which is positioned over the vaporizing plates 21 at a relatively narrow space A between the covering plate 34 and the upper edges of the vaporizing plates 21. Consequently, the upward air current is guided in the machine compartment 7 by the covering plate 34 as shown by arrow B in FIG. 1 so as to effectively pass by the upper end portions of the vaporizing plates 21, thereby enhancing vaporization of the defrost water. Furthermore, since the defrost water is subjected to the heat of the high temperature gas refrigerant passing through the condenser tube 9**, the vaporization of the defrost water is further enhanced.

According to the defrost-water vaporizer described above, the water reservoir 11 receiving the defrost water is provided with a plurality of vaporizing plates 21. The defrost water from the evaporator 5 is absorbed by the vaporizing plates 21. The defrost water absorbed by the vaporizing plates 21 is vaporized from the surfaces thereof. Consequently, an vaporization area of the defrost water is increased as compared with the conventional defrost-water vaporizer in which the defrost water is received by the vaporizing pan and vaporized only from the surface thereof, thereby improving the vaporization efficiency.

Since the upward air current induced by the heat generated by the compressor 8 is guided by the covering plate 34 so as to effectively pass by the upper end portions of the vaporizing plates 21, the defrost water vaporization efficiency is further improved. Consequently, this improvement of the vaporization efficiency renders the construction of vaporizing the defrost water compact, which further allows the machine compartment 7 to be small-sized. Additionally, the inner volume of the cabinet 1 may be enlarged and the volume efficiency of the cabinet 1 may be improved.

Since the vaporizing plates 21 are supported at the upper portions by the covering plate 34, which is secured to the refrigerator body, the covering plate 34 may prevent the vaporizing plates 21 from colliding with the walls of the cabinet 1 owing to vibration. Consequently, occurrence of noise, breakage of the vaporizing plates 21, and the tearing of paint film of the cabinet 1 may be prevented.

Although the upper portions of the vaporizing plates 21 are supported by the upper support 24 and the covering plate 34 in the foregoing embodiment, the upper portions of the vaporizing plates 21 may be directly supported by the covering plate 34 without employing the upper support 24. Furthermore, means for securing the covering plate 34 to the vaporizing plates 21 and to the cabinet 1 may be changed without departing from the scope of the invention.

Although the covering plate 34 is provided so as to cover the vaporizing plates 21 in the foregoing embodiment, the covering plate 34 may not be employed where the machine compartment is designed so as to have a small height.

Figure 6:
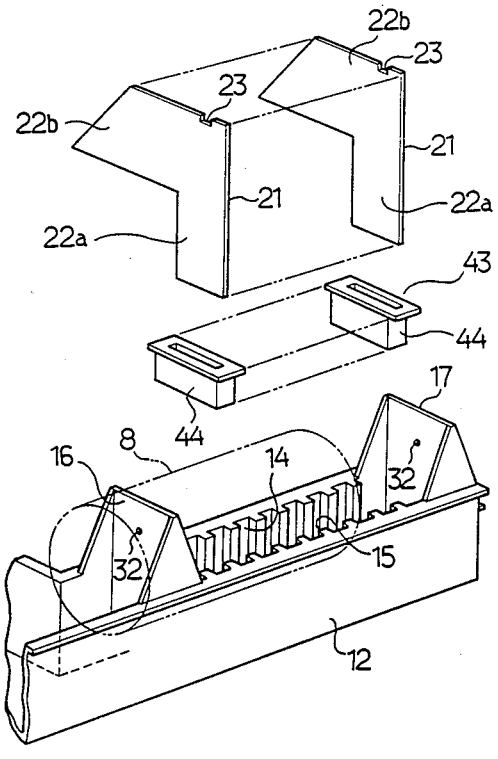
FIG. 6 is a partially exploded perspective view of the defrost-water vaporizer of a second embodiment in accordance with the invention.

FIG. 6 illustrates a second embodiment of the defrost-water vaporizer of a refrigerator. In FIG. 5, a lower support 43 employed for the lower support 18 has independent rectangular members 44 formed from an elastic material such as ethylene propylene rubber. The number and arrangement spacing of the rectangular members 44 correspond to those of the grooves 14 and 15 of the water reservoir 11. The same effect may be achieved in the second embodiment as in the foregoing embodiment.

The foregoing disclosure and drawings are merely illustrative of the principles of the present invention and are not to be interpreted in a limiting sense. The only limitation is to be determined from the scope of the appended claims.

We claim:

1. A defrost-water vaporizer of a refrigerator including a heat-insulated cabinet having a storage space at the interior and provided with an evaporator, a machine compartment provided at the outside of the heat-insulated cabinet so as to have a surface open to the atmosphere, a compressor mounted in the machine compartment for supplying the evaporator with refrigerant, and a defrost-water vaporizer provided in the machine compartment, the defrost-water vaporizer comprising:

(a) a water reservoir provided in the machine compartment for receiving defrost water resulting from the melting of frost adherent to the evaporator to be discharged outside the storage space of the heat-insulated cabinet;

(b) a plurality of vaporizing elements each having a lower portion inserted in the water reservoir so as to come into contact with the defrost water in the water reservoir and an upper portion disposed higher than the compressor, the vaporizing elements absorbing the defrost water in the water reservoir by capillarity to thereby vaporize the absorbed water from the surfaces thereof; and (c) a lower support formed from an elastic material and provided between the lower portion of each vaporizing element and the inner surface of a side wall of the water reservoir, the lower support supporting the vaporizing elements in the water reservoir.

2. A defrost-water vaporizer of a refrigerator as claimed in claim 1, wherein each vaporizing element comprises a raised portion raised from the water reservoir and an extended portion laterally extended from the upper portion of the raised plate portion, the extended portion being placed over the compressor.

3. A defrost-water vaporizer of a refrigerator including a heat-insulated cabinet having a storage space at the interior, the storage space being provided with an evaporator, a machine compartment provided at the outside of the heat-insulated cabinet and having a surface open to the atmosphere, a compressor provided in the machine compartment to supply the evaporator with refrigerant, and a defrost-water vaporizer provided in the machine compartment, the defrost-water vaporizer comprising:

(a) a water reservoir provided in the machine compartment for receiving defrost water resulting from the melting of frost adherent to the evaporator to be discharged outside the storage space, the water reservoir comprising a narrow portion having an upper open end and positioned so as to be adjacent to an elongated side wall of the compressor, a wide portion adjacent to one end of the compressor, a plurality of grooves longitudinally formed in the inner surfaces of oppositely disposed walls of the narrow portion, and two holding members secured to both elongated ends of the narrow portion respectively;

(b) a lower support formed from an elastic material, the lower support having a plurality of generally rectangular portions fitted in the grooves of the water reservoir and a flanged portion integrally coupling the cylindrical portions with one another;

(c) a plurality of vaporizing elements provided for absorbing and vaporizing the defrost water received by the water reservoir, each vaporizing element formed from a porous material having water absorbing property by capillarity and including a raised portion raised from the water reservoir and an extended portion laterally extended from the upper end thereof, the raised portions being inserted in the narrow portions of the water reservoir through the rectangular portions of the lower support to be thereby positioned at predetermined intervals, respectively, the extended portions of the vaporizing elements being placed over the compressor; and (d) an upper support provided for supporting the upper ends of the vaporizing elements to the water reservoir, the upper support including a generally U-shaped, downwardly directed supporting member and a spacer formed from an elastic material and disposed between the supporting member and the vaporizing elements, both ends of the supporting member being secured to the respective holding members of the water reservoir, the spacer having, in the upper surface, a groove with which the upper portion of the supporting member is fitted, and, in the lower surface, grooves formed so as to correspond to the vaporizing elements so that the upper edges of the vaporizing elements are fitted therein, respectively.

4. A defrost-water vaporizer of a refrigerator as claimed in claim 3, wherein the lower support comprises a plurality of independent, generally rectangular members each formed from an elastic material, the rectangular members being fitted in the grooves of the water reservoir, respectively.

5. A defrost-water vaporizer of a refrigerator including a heat-insulated cabinet having a storage space in the interior, the storage space being provided with an evaporator, a machine compartment provided at the outside of the cabinet and having a surface open to the atmosphere, a compressor provided in the machine compartment for supplying the evaporator with refrigerant, and a defrost-water vaporizer provided in the machine compartment, the defrost-water vaporizer comprising:

(a) a water reservoir provided in the machine compartment for receiving defrost water resulting from the melting of frost adherent to the evaporator to be discharged outside the storage space;

(b) a plurality of vaporizing elements each having a lower portion inserted in the water reservoir so as to come into contact with the defrost water in the water reservoir and an upper portion disposed higher than the compressor, the vaporizing elements absorbing the defrost water received by the water reservoir by capillarity to thereby vaporize the defrost water from the surfaces thereof open to the atmosphere;

(c) a lower support formed from an elastic material and provided between the lower portion of each vaporizing element and the inner surface of a side wall of the water reservoir, the lower support supporting the vaporizing elements in the water reservoir;

(d) an upper support formed from an elastic material and supporting the upper portions of the vaporizing elements to the water reservoir; and (e) a covering plate having one end secured to the heat-insulated cabinet side so that the vaporizing elements are covered with the covering plate at a predetermined space therebetween.

6. A defrost-water vaporizer of a refrigerator as claimed in claim 5, wherein the other end of the covering plate is secured to the upper support.

* * * * *